US009627795B2

(12) United States Patent
Smith

(10) Patent No.: US 9,627,795 B2
(45) Date of Patent: Apr. 18, 2017

(54) ELECTRICAL CONNECTING ASSEMBLIES, AND RELATED METHODS

(71) Applicant: Duane K. Smith, St. Charles, MO (US)

(72) Inventor: Duane K. Smith, St. Charles, MO (US)

( * ) Notice: Subject to any disclaimer, the term of this patent is extended or adjusted under 35 U.S.C. 154(b) by 0 days.

(21) Appl. No.: 14/947,755

(22) Filed: Nov. 20, 2015

(65) Prior Publication Data

US 2016/0149336 A1 May 26, 2016

Related U.S. Application Data

(60) Provisional application No. 62/083,049, filed on Nov. 21, 2014.

(51) Int. Cl.
*H01R 13/506* (2006.01)
*H01R 4/22* (2006.01)
*H01R 13/52* (2006.01)

(52) U.S. Cl.
CPC ..... *H01R 13/506* (2013.01); *H01R 4/22* (2013.01); *H01R 13/5216* (2013.01)

(58) Field of Classification Search
CPC ..... H01R 4/22
USPC ..... 174/87
See application file for complete search history.

(56) References Cited

U.S. PATENT DOCUMENTS 454,181 A 6/1891 Nash et al.
2,589,368 A * 3/1952 Graham ..... H01R 4/22 174/87
2,701,273 A * 2/1955 Badeau ..... H01R 4/22 174/138 F
2,748,186 A * 5/1956 Lee ..... H01R 4/22 174/87
2,792,444 A * 5/1957 Bergan ..... H01R 4/22 174/138 F
2,823,249 A * 2/1958 Curtiss ..... H01R 4/22 174/138 F
2,870,239 A * 1/1959 Ustin ..... H01R 4/22 174/138 F
3,132,202 A * 5/1964 Wolf ..... H01R 4/22 174/138 F
3,165,575 A 1/1965 Lynch, Jr. et al.
3,350,499 A * 10/1967 Swanson ..... H01R 4/22 174/138 F (Continued)

FOREIGN PATENT DOCUMENTS

WO WO 2016/081870 A1 5/2016

OTHER PUBLICATIONS

Data sheet titled "DBY-6 Direct Bury Splice Kit 600 Volts" issued by 3M Division (2 pages) Feb. 13, 1992.

(Continued)

*Primary Examiner* — Ross Gushi
(74) *Attorney, Agent, or Firm* — Harness, Dickey & Pierce, P.L.C.

(57) ABSTRACT

An assembly for electrically connecting at least two wires is provided. The assembly includes a body configured to receive a connector therein for electrically connecting at least two wires, and a retainer configured to releasably couple to the body. The retainer has at least one arm configured to extend into the body, when the retainer is coupled to the body, and inhibit movement of the connector out of the body after the connector is received in the body. Methods of making an electrical connection using an electrical connecting assembly are also disclosed.

21 Claims, 8 Drawing Sheets

(56) References Cited

U.S. PATENT DOCUMENTS 3,388,367 A 6/1968 Brown
3,483,310 A * 12/1969 Krup ..... H01R 4/22 174/138 F
3,558,800 A * 1/1971 Wallis ..... H01R 4/22 174/76
3,597,528 A * 8/1971 Penfield ..... H01R 4/22 174/76
3,757,031 A 9/1973 Izraeli
3,864,013 A 2/1975 Levy
3,875,324 A * 4/1975 Waddington ..... H01R 4/22 174/87
3,902,005 A * 8/1975 Norden ..... H01R 4/22 174/138 F
4,112,251 A * 9/1978 Scott ..... H01R 4/22 174/87
4,125,310 A 11/1978 Reardon, II et al.
4,227,040 A * 10/1980 Scott ..... H01R 4/22 174/87
4,288,657 A * 9/1981 Swanson ..... H01R 4/22 174/87
4,454,376 A * 6/1984 Holder ..... H01R 4/12 174/84 S
4,611,872 A 9/1986 Ito et al.
4,647,717 A 3/1987 Uken
4,673,233 A 6/1987 Hertelendy
4,684,195 A 8/1987 Anderson et al.
4,686,326 A * 8/1987 Rich ..... H01R 4/22 174/84 S
4,740,656 A * 4/1988 Rich ..... H01R 4/22 174/84 S
4,839,473 A * 6/1989 Fox ..... H02G 15/18 174/138 F
4,963,700 A 10/1990 Olsen et al.
5,001,301 A * 3/1991 Marr ..... H01R 4/22 174/87
5,023,402 A * 6/1991 King, Jr. ..... H01R 4/22 174/87
5,113,037 A * 5/1992 King, Jr. ..... H01R 4/22 174/87
5,137,476 A 8/1992 Noble
5,151,239 A * 9/1992 King, Jr. ..... H01R 4/22 174/87
5,252,779 A * 10/1993 DiRienzo ..... H01R 4/70 174/74 R
5,306,195 A 4/1994 Hayashi
5,315,066 A * 5/1994 Spiteri, Sr. ..... H01R 4/22 174/87
5,378,855 A * 1/1995 Delalle ..... H01R 4/22 174/84 R
5,427,270 A * 6/1995 Patterson ..... H01R 4/22 174/135
5,431,758 A * 7/1995 Delalle ..... H02G 15/043 156/49
5,482,475 A 1/1996 Kawaguchi
5,514,836 A * 5/1996 Delalle ..... H01R 4/22 174/74 R
5,531,618 A * 7/1996 Market ..... H01R 4/22 174/87
5,557,069 A * 9/1996 Whitehead ..... H01R 4/22 174/138 F
5,557,070 A 9/1996 Tamm
5,559,307 A * 9/1996 Whitehead ..... H01R 4/22 174/138 F
5,685,735 A 11/1997 Hohorst
5,708,234 A * 1/1998 Frontierro ..... H01R 4/62 174/87
5,894,110 A * 4/1999 Simmons ..... H01R 4/22 174/87
5,922,992 A 7/1999 Kinney et al.
5,922,994 A * 7/1999 Robinson, Sr. ..... H01R 4/22 174/87
5,954,539 A * 9/1999 Hornung ..... H01R 4/22 174/67
6,025,559 A * 2/2000 Simmons ..... H01R 4/22 174/87
6,051,791 A * 4/2000 King ..... H01R 4/12 174/87
6,152,759 A 11/2000 Daoud et al.
6,198,049 B1 * 3/2001 Korinek ..... B25B 23/1415 174/87
RE37,340 E * 8/2001 King, Jr. ..... H01R 4/22 174/87
6,414,243 B1 * 7/2002 Korinek ..... H01R 4/22 174/87
6,478,606 B1 * 11/2002 McNerney ..... H01R 4/22 174/87
6,570,094 B2 * 5/2003 King, Jr. ..... H01R 4/22 174/87
6,677,530 B2 * 1/2004 Blaha ..... H01R 13/5025 174/84 R
6,688,921 B2 2/2004 Borgstrom et al.
6,784,370 B1 8/2004 Keswani et al.
6,815,616 B1 * 11/2004 King, Jr. ..... H01R 4/22 174/87
6,817,910 B2 11/2004 Borgstrom et al.
6,854,996 B2 2/2005 Yaworski et al.
6,878,880 B2 * 4/2005 King, Jr. ..... H01R 4/12 174/87
6,958,449 B1 * 10/2005 Ziebart ..... H01R 4/12 174/84 R
7,037,128 B2 5/2006 Yaworski et al.
7,038,136 B2 * 5/2006 King, Jr. ..... H01R 4/22 174/87
7,090,532 B1 8/2006 Kaine
7,122,742 B2 * 10/2006 King, Jr. ..... H01R 4/22 174/87
7,129,414 B2 * 10/2006 King, Jr. ..... H01R 4/12 174/87
7,170,005 B1 1/2007 King, Jr. et al.
7,186,132 B2 3/2007 Quintanilla
7,232,953 B2 * 6/2007 Torii ..... H01R 4/22 174/74 R
7,262,363 B2 * 8/2007 Fukuda ..... H01R 13/5213 174/84 C
7,335,050 B2 2/2008 Kirk et al.
7,365,270 B2 * 4/2008 Michaud ..... H01R 4/12 174/87
7,368,663 B1 * 5/2008 Fisher ..... H02G 15/04 174/74 R
D575,230 S 8/2008 Bishop et al.
D575,738 S 8/2008 Kirk et al.
7,420,122 B2 * 9/2008 King, Jr. ..... H01R 4/22 174/87
7,560,645 B2 * 7/2009 King, Jr. ..... H01R 4/22 174/87
7,736,165 B2 6/2010 Bukovnik et al.
7,788,803 B2 * 9/2010 King, Jr. ..... H01R 4/22 29/874
7,806,718 B2 10/2010 King et al.
8,062,056 B2 11/2011 Lee
8,067,692 B2 * 11/2011 Hiner ..... H01R 4/22 174/87
8,212,147 B2 * 7/2012 Rhea ..... H01R 4/22 174/87
8,262,405 B1 9/2012 Bishop
8,348,705 B2 * 1/2013 Dickenson ..... H01R 4/12 174/87
8,408,929 B2 4/2013 Solon
8,512,066 B2 8/2013 Lee
8,525,026 B1 * 9/2013 Rhea ..... H01R 4/22 174/87
8,569,623 B2 * 10/2013 Matsuoka ..... H01R 13/5208 174/74 R
9,035,184 B2 5/2015 Boaz et al.
9,231,313 B2 * 1/2016 King, Jr. ..... H01R 4/22
9,252,504 B1 * 2/2016 Shechter ..... H01R 4/12
2006/0180336 A1 * 8/2006 King, Jr. ..... H01R 4/22 174/87

(56) References Cited

U.S. PATENT DOCUMENTS

| | | | | |
|---|---|---|---|---|
| 2007/0178752 | A1* | 8/2007 | Bigelow | H01R 4/22 439/497 |
| 2008/0053681 | A1* | 3/2008 | King, Jr. | H01R 4/22 174/87 |
| 2008/0073103 | A1* | 3/2008 | King, Jr. | H01R 4/22 174/87 |
| 2008/0110301 | A1* | 5/2008 | DeRuntz | B25B 33/00 81/176.1 |
| 2009/0017660 | A1 | 1/2009 | Braganza et al. | |
| 2010/0048054 | A1 | 2/2010 | Okayasu | |
| 2010/0173515 | A1* | 7/2010 | Dickenson | H01R 4/12 439/391 |
| 2011/0120841 | A1 | 5/2011 | Sandano | |
| 2012/0034796 | A1* | 2/2012 | Joye | H01R 4/20 439/147 |
| 2012/0217034 | A1* | 8/2012 | King, Jr. | H01R 4/22 174/87 |
| 2013/0307528 | A1* | 11/2013 | King, Jr. | H01R 4/22 324/157 |
| 2014/0041895 | A1* | 2/2014 | King, Jr. | H01R 4/22 174/87 |
| 2015/0325931 | A1 | 11/2015 | Boaz et al. | |
| 2016/0118724 | A1* | 4/2016 | Wootton | G01R 15/18 324/127 |
| 2016/0149336 | A1* | 5/2016 | Smith | H01R 13/5216 439/587 |

OTHER PUBLICATIONS

Data sheet titled "DBY/DBR and DBY-6/DBR/6 Direct Bury Splice Kits" issued by 3M Electrical Products Division (2 pages) 1993.

* cited by examiner

ELECTRICAL CONNECTING ASSEMBLIES, AND RELATED METHODS

CROSS-REFERENCE TO RELATED APPLICATION

This application claims the benefit of and priority to U.S. Provisional Application No. 62/083,049, filed on Nov. 21, 2014. The entire disclosure of the above application is incorporated herein by reference.

FIELD

The present disclosure generally relates to electrical connecting assemblies that can be used, for example, to electrically connect wires, and methods related thereto.

BACKGROUND

This section provides background information related to the present disclosure which is not necessarily prior art.

Electrical connectors are often used for connecting various electrical components of electrical equipment or systems. By way of example, both lawn sprinkler systems and landscape lighting systems include a plurality of electrical components that are typically connected using electrical connectors.

SUMMARY

This section provides a general summary of the disclosure, and is not a comprehensive disclosure of its full scope or all of its features.

Exemplary embodiments of the present disclosure generally relate to electrical connecting assemblies. In one exemplary embodiment, such an assembly generally includes a body configured to receive a connector therein for electrically connecting at least two wires, and a retainer configured to releasably couple to the body. The retainer has at least one arm configured to extend into the body, when the retainer is coupled to the body, and inhibit movement of the connector out of the body after the connector is received in the body.

In another exemplary embodiment, an assembly for electrically connecting wires generally includes a connector configured to electrically connect the wires, a body defining an opening for receiving the connector into the body when the connector is electrically connecting the wires, and a retainer configured to couple to the body adjacent the opening of the body. The retainer has at least one arm configured to extend through the opening of the body, when the retainer is coupled to the body, to inhibit movement of the connector out of the body after the connector is received in the body Exemplary embodiments of the present disclosure also generally relate to methods of making an electrical connection using an electrical connecting assembly. In one exemplary embodiment, such a method generally includes inserting at least two electrical wires into an opening of a connector of the assembly, moving the connector through an opening of a retainer of the assembly and into a body of the assembly, and coupling the retainer of the assembly to the body of the assembly, such that an arm of the retainer is positioned within the body for inhibiting movement of the connector out of the body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
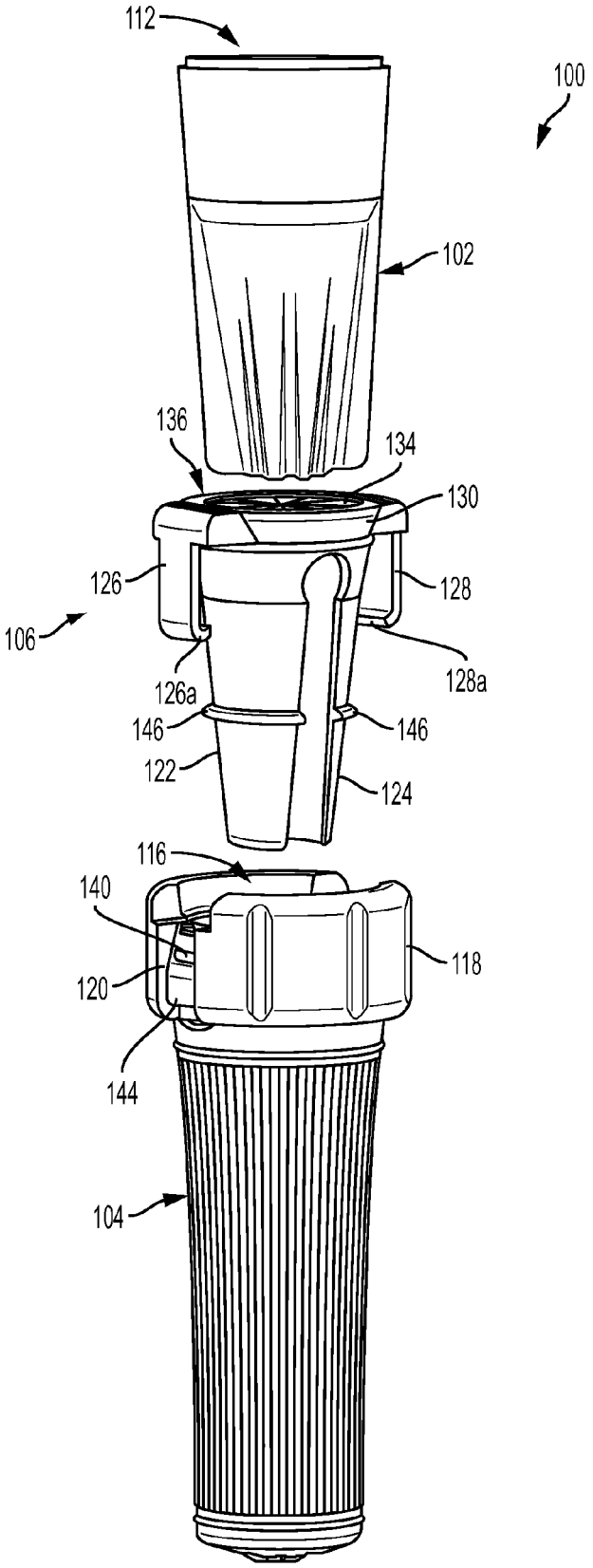
FIG. 1 is an exploded perspective view of an exemplary embodiment of an assembly according to the present disclosure for use in electrically connecting at least two wires.

The present disclosure is generally directed toward electrical connecting assemblies that can be used, for example, for electrically connecting wires. Exemplary embodiments of the electrical connecting assemblies generally include a body (e.g., a base, a receptacle, a tube, etc.) configured to receive a connector (e.g., a twist-on wire connector, etc.) therein for electrically connecting at least two wires, and a retainer (e.g., a plunger lid, a cap, a cover, etc.) configured to releasably (e.g., snap-fit, etc.) couple to the body. The retainer has at least one arm (e.g., at least one member, at least one protrusion, etc.) configured to extend into the body when the retainer is coupled to the body, and inhibit movement of the connector out of the body and after the connector is received in the body.

In some embodiments, the assemblies include the connector. In some aspects, the connector defines an opening for receiving the at least two wires into the connector for electrically connecting the wires (e.g., via electrical contact of exposed ends of the wires, etc.). For example, the connector may include a metallic coil for electrically connecting the wires. The connector may include a plurality of fingers (e.g., resilient fingers, tabs, etc.) adjacent the opening for flexibly engaging the wires when the wires are received through the opening. For example, the fingers may direct the wires toward a center of the opening of the connector, provide strain relief to the wires, assist in holding the wires in place in the connector, assist in preventing water and/or other substances from entering the connector, etc.

In some embodiments, the assemblies include sealant (e.g., grease, etc.) disposed within the body of the assemblies and/or the connector. For example, the sealant may be disposed in both the connector and the body to inhibit water from entering the connector and interfering with the electrical connection between the wires. When the sealant is disposed in the body, at least one arm of the retainer may be configured to direct the sealant toward an opening of the connector (e.g., an opening through which the at least two wires are received into the connector, etc.), after the connector is received in the body and when the retainer is coupled to the body. Hence, the at least one arm of the retainer may assist in directing sealant against the opening of the connector to provide further inhibition of water from entering the connector and interfering with the electrical connection between the wires (e.g., if water inadvertently enters the body, etc.).

In some embodiments, the body of the assemblies defines an opening configured to permit the connector to be inserted through the opening and into the body, with the at least one arm of the retainer configured to be positioned in the body through the opening and with the retainer configured to releasably couple to the body adjacent the opening of the body. For example, the opening may be at one end of the body and the retainer may snap-fit to that end of the body. The retainer may also define an opening configured to generally align with the opening of the body when the at least one arm of the retainer is disposed at least partially in the body, with the aligned openings configured to receive the connector therethrough for receiving the connector into the body. For example, the connector may be received into the body by inserting the connector through openings in both the retainer and the body, when the at least one arm of the retainer is already disposed at least partially in the body, and the retainer can then be coupled to the body. In other embodiments, the connector can be received into the body of the assemblies before the at least one arm of the retainer is disposed at least partially in the body. Further, in some embodiments, it may be possible to insert the connector into the body even after the retainer has already been coupled to the body.

In some embodiments, the retainer of the assemblies includes at least two arms, which are configured to resiliently move generally away from each other to permit the connector to pass between the at least two arms when receiving the connector in the body, and then to move generally toward each other after the connector is received in the body. For example, the at least two arms may be pushed apart by the connector, while the at least two arms are located at least partially in the body, as the connector is inserted through an opening in the retainer. Once the connector moves past the at least two arms, the arms may move back toward each other, thereby inhibiting the connector from being removed from the body (e.g., by contacting the top of the connector and securing it in the body, etc.). In some aspects, this movement of the at least two arms back towards each other also directs sealant (when the sealant is present in the body) toward an upper opening of the connector (e.g., an opening through which the at least two wires are received into the connector, etc.).

In some embodiments, the retainer of the assemblies includes a plurality of fingers adjacent an upper opening of the retainer for flexibly engaging the at least two wires electrically connected by the connector, when the connector is received in the body. The fingers may orient the wires towards the center of the retainer opening, provide strain relief to the wires, assist in holding the wires in place in the body, inhibit water and/or other substances from entering the body, etc. In some of these embodiments, the body also includes a lip, and the retainer includes a clasp configured to engage the lip for releasably coupling the retainer to the body.

With that said, it should be appreciated that the electrical connecting assemblies of the present disclosure may facilitate electrical connection of wires while also inhibiting water and/or other substances from interfering with the electrical connection of the wires, thereby providing for electrical connection of the wires in outdoor, underground, etc. environments that may otherwise expose the electrical connection to harmful elements (e.g., in connection with lawn sprinkler systems, landscape lighting systems, etc.) etc.

It should also be appreciated that the electrical connecting assemblies of the present disclosure can include one or more of the above described aspects/features in any desired combination, and can further include any of the other features described herein as desired.

With reference now to the drawings, FIGS. 1-8 illustrate an exemplary embodiment of an electrical connecting assembly 100, and components thereof, having one or more aspects of the present disclosure. The assembly 100 can be used to electrically connect at least two wires (not shown), and can be used to protect an electrical connection of the wires from harmful elements (e.g., water, dirt, etc.).

As shown in FIGS. 1-5, the illustrated assembly 100 generally includes a connector 102, a body 104, and a retainer 106. In use, the connector 102 is configured to electrically connect wires (e.g., at least two wires, etc.) inserted into the connector 102. The body 104 is then configured to receive the connector 102, and the electrically connected wires, therein. And, the retainer 106 is configured to releasably couple to the body 104 to help secure the connector 102 (and the wires electrically connected by the connector 102) in the body 104.

Figure 5:
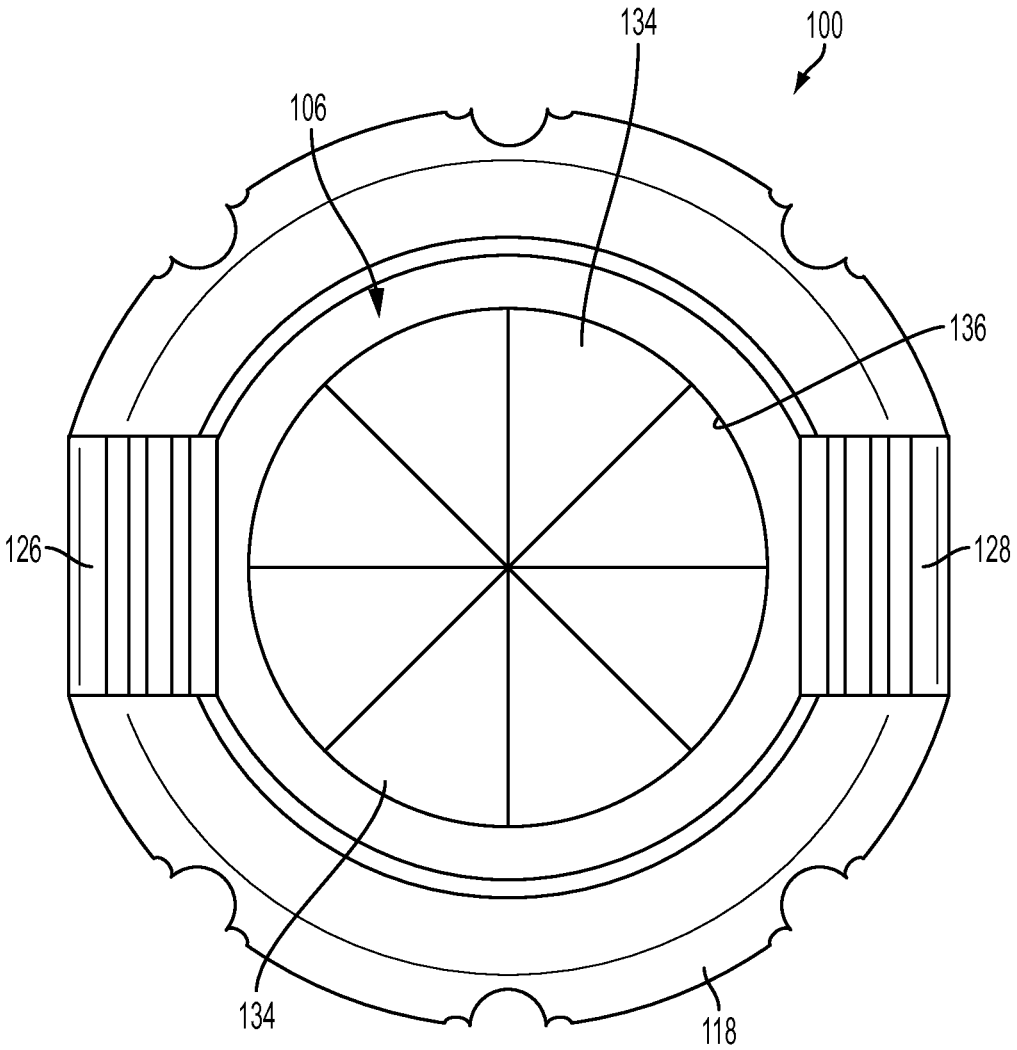
FIG. 5 is a top view of the assembly of FIG. 4.

The connector 102 of the illustrated assembly 100 generally includes a twist-on type wire connector for connecting the wires inserted therein. To accomplish the connection, the connector 102 includes a metallic coil 108 disposed therein to electrically connect the wires (FIG. 5). With that said, it should be appreciated that other types of connectors may be used in other embodiments, for example, connectors other than twist-on type wire connectors, etc.

Figure 2:
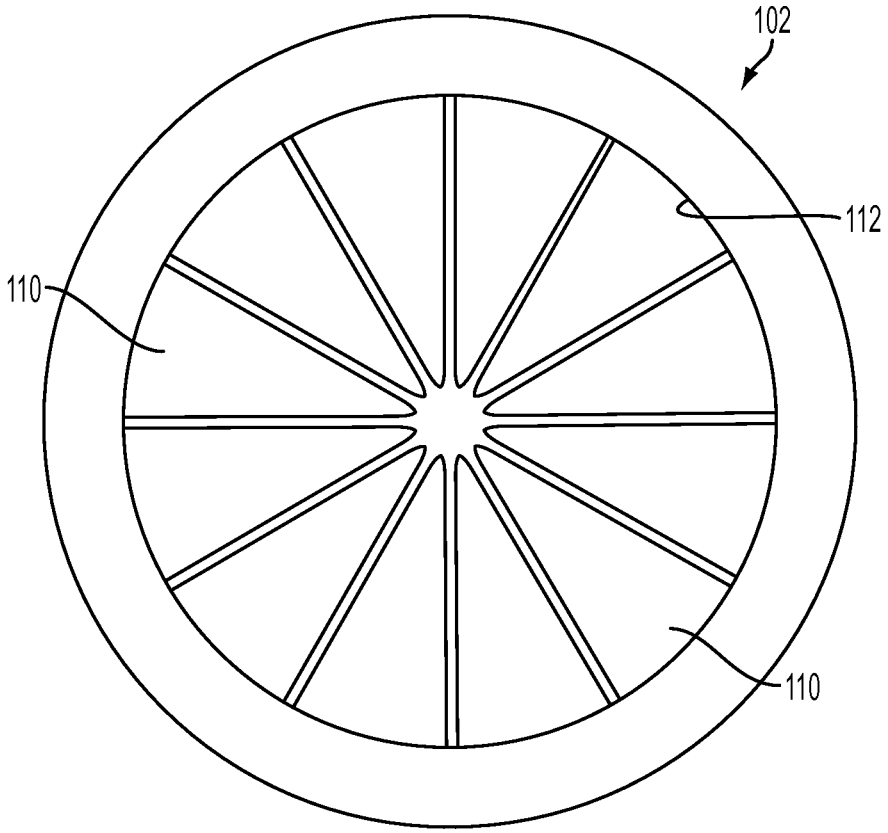
FIG. 2 is a top view of a connector of the assembly of FIG. 1.
Figure 3:
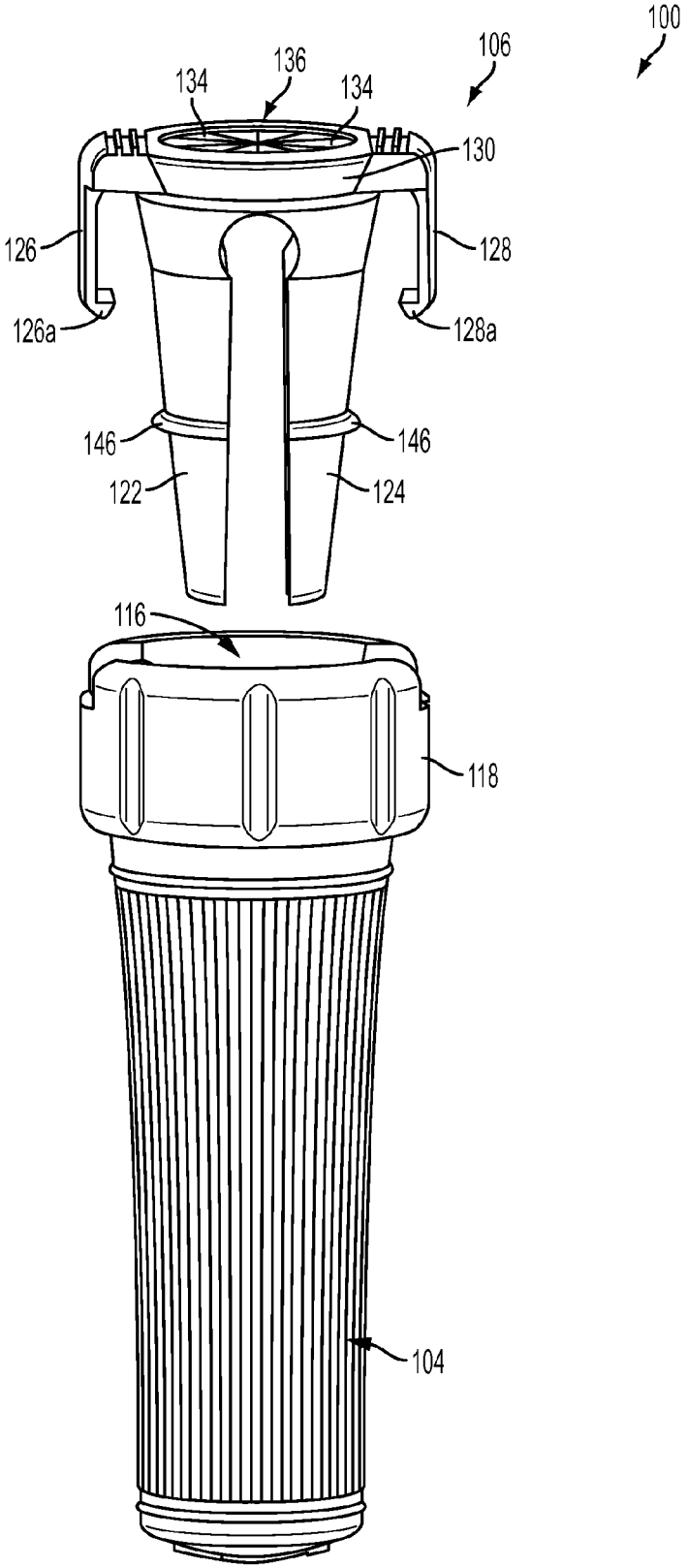
FIG. 3 is another exploded perspective view of the assembly of FIG. 1, with the connector removed.
Figure 4:
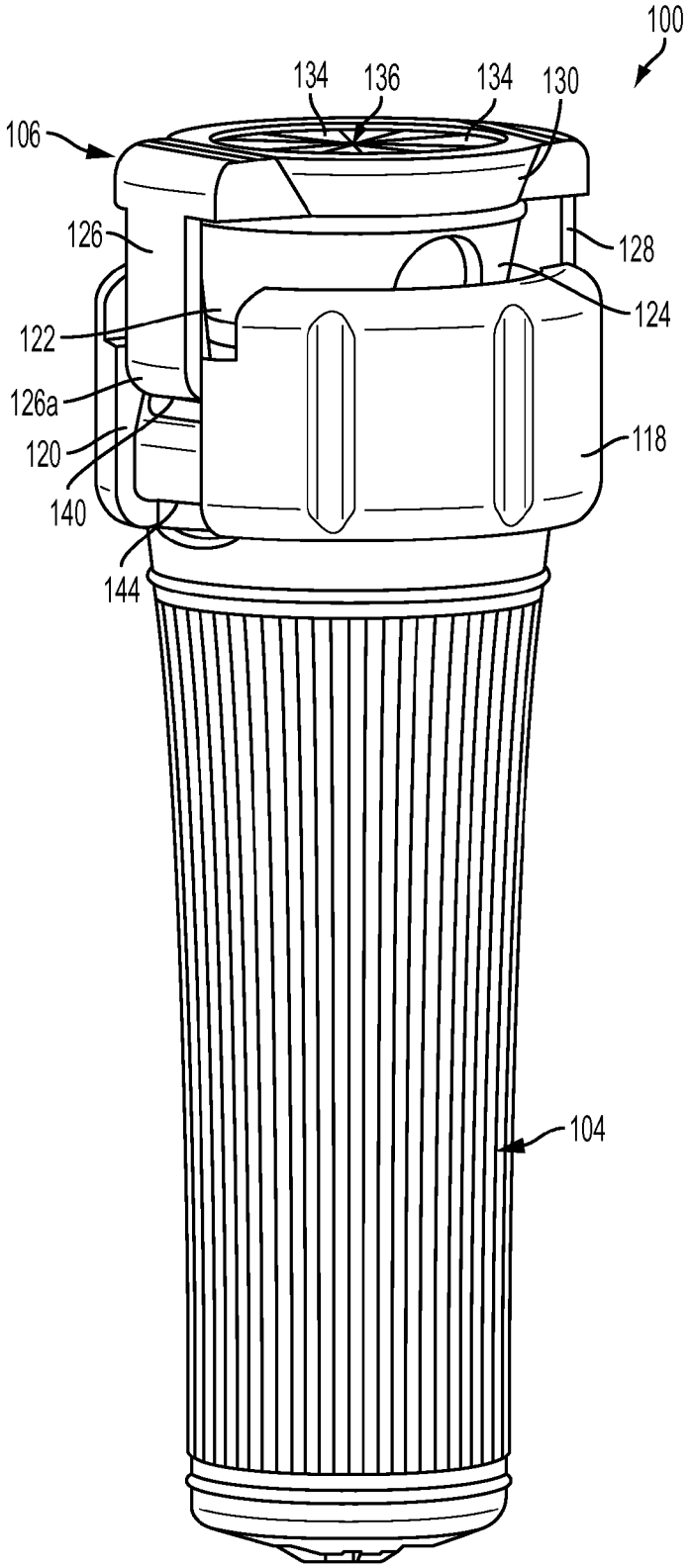
FIG. 4 is a perspective view of the assembly of FIG. 3, with a retainer of the assembly shown in a first position partially inserted into a body of the assembly.

The connector 102 also includes a plurality of fingers 110 adjacent an upper opening 112 of the connector 102 (where the wires are inserted into the connector 102 to facilitate the electrical connection) (FIG. 2). The fingers 110 are resiliently flexible and are configured to engage the wires received through the connector opening 112. Among other things, the fingers 110 operate, generally, to direct the wires toward a center of the opening 112, to provide strain relief to the wires in the connector 102, to assist in holding the wires in place in the connector 102, to assist in preventing water and/or other substances/debris from entering the connector 102, etc. In the illustrated embodiment, the fingers 110 are slightly spaced apart from each other and an opening is provided toward tips of the fingers. This configuration (while not required in all embodiments) may help improve connections of wires using the connector 102. It should be appreciated that the connector 102 can include any suitable number of fingers 110, which may or may not cover substantially the entire opening 112 of the connector 102. The connector 102 and/or the fingers 110 may comprise any suitable similar or different material (e.g., plastic, rubber, etc.). In addition, in other embodiments (and as described above), assemblies may include different connectors (e.g., different from connector 102, etc.) and/or connectors with other suitable electrical connection components.

In some embodiments, the connector 102 of the assembly 100 also includes an insulating material (or sealant) therein to help coat, surround, etc. the wires (e.g., the bare end portions of the wires, etc.) when the wires are inserted into the connector 102. Any suitable insulating material may be used including, for example, a moisture resistant encapsulant or gel that is viscous or non-viscous, a hardening or non-hardening epoxy or potting compound, etc. In some implementations, the insulating material may have a sufficient viscosity so that it will not flow out of the connector 102, but at the same time will move with the wires and flow around them as they are connected in the connector 102 (e.g., to provide a seal around the connected wires in the connector 102 to inhibit water and/or other substances/debris from interfering with the electrical connection of the wires, etc.).

With continued reference to FIGS. 1-5, the body 104 of the assembly 100 includes a generally closed lower end portion and a generally open upper end portion. An opening 116 is defined at the upper end portion of the body 104, with an enlarged rim 118 extending partially around the opening 116. And, guides 120 are defined in the rim 118, on generally opposite sides of the body 104. The body 104 may be formed from any suitable material including, for example, plastic, rubber, etc. In addition, in other embodiments, assemblies may include bodies having different shapes and/or configurations than illustrated herein. In addition, it should be appreciated that the body 104 of the assembly 100 can receive various different sizes of connectors (e.g., the size of the connector 102 does not need to match the size of the body 104, etc.). As such, the body 104 is configured to allow connectors of multiple different sizes to be inserted into and retained within the body 104.

The retainer 106 of the assembly 100 includes first and second arms 122, 124, and first and second clasps 126, 128 for use in coupling the retainer 106 to the body 104. The arms 122, 124 are resiliently coupled to a neck 130 of the retainer 106, and are separated by a gap (or spacing). As such, the arms 122, 124 can each independently flex, relative to the neck 130, toward and away from each other (as will be described more hereinafter). It should be appreciated that the gap between the arms 122, 124 may have any suitable shape and/or size within the scope of the present disclosure. The clasps 126, 128 of the retainer 106 are also resiliently coupled to the neck 130, and can flex in similar fashion to the arms 122, 124. Although the illustrated retainer 106 includes two arms 122, 124 and two clasps 126, 128, in other embodiments, assemblies may include retainers having different numbers of arms and/or different numbers of clasps (e.g., one, three, four, etc.). In addition, in other embodiments, assemblies may include retainers with engagement components other than clasps (e.g., screw threads, friction fit devices, etc.) for use in coupling the retainers to bodies of the assemblies.

The illustrated retainer 106 also includes a plurality of fingers 134 adjacent an upper opening 136 of the retainer 106. The fingers 134 are resiliently flexible and are configured to engage the wires received through the opening 136, when the connector 102 is positioned in the body 104 of the assembly 100 (as will be described more hereinafter). Among other things, the fingers 134 operate, generally, to direct the wires toward a center of the opening 136, to provide strain relief to the wires in the assembly 100, to assist in holding the wires in place in the assembly 100, to assist in preventing water and/or other substances/debris from entering the assembly 100, etc. The fingers 134 may be formed integrally with the retainer 106, or the fingers 134 may be formed as a structure separate from the retainer 106 and coupled thereto as desired (e.g., snap-fit to the retainer 106 at opening 136 via circumferential tabs on a base structure supporting the fingers 134, where the tabs are received in corresponding openings within the neck 130 of the retainer 106; etc.). It should be appreciated that a similar construction may also be used for the fingers 110 of the connector 102.

As described for the connector 102 and the body 104, the retainer 106 (and/or the fingers 134 thereof) may also be formed from any suitable material including, for example, plastic, rubber, etc. In addition, in other embodiments, assemblies may include retainers having different shapes and/or configurations than illustrated herein.

Use of the assembly 100 will be described next, with reference to FIGS. 6-8. In the illustrated embodiment, the retainer 106 is initially positioned partially within the body 104. And, the connector 102, with the wires electrically connected therein, is then inserted into the body 104 through the retainer 106. However, it should be appreciated that in other embodiments, the connector 102 (with the wires electrically connected therein) can be initially inserted into the body 104 (before the retainer 106), and the retainer 106 then positioned within the body 104 generally over the connector 102.

Figure 6:
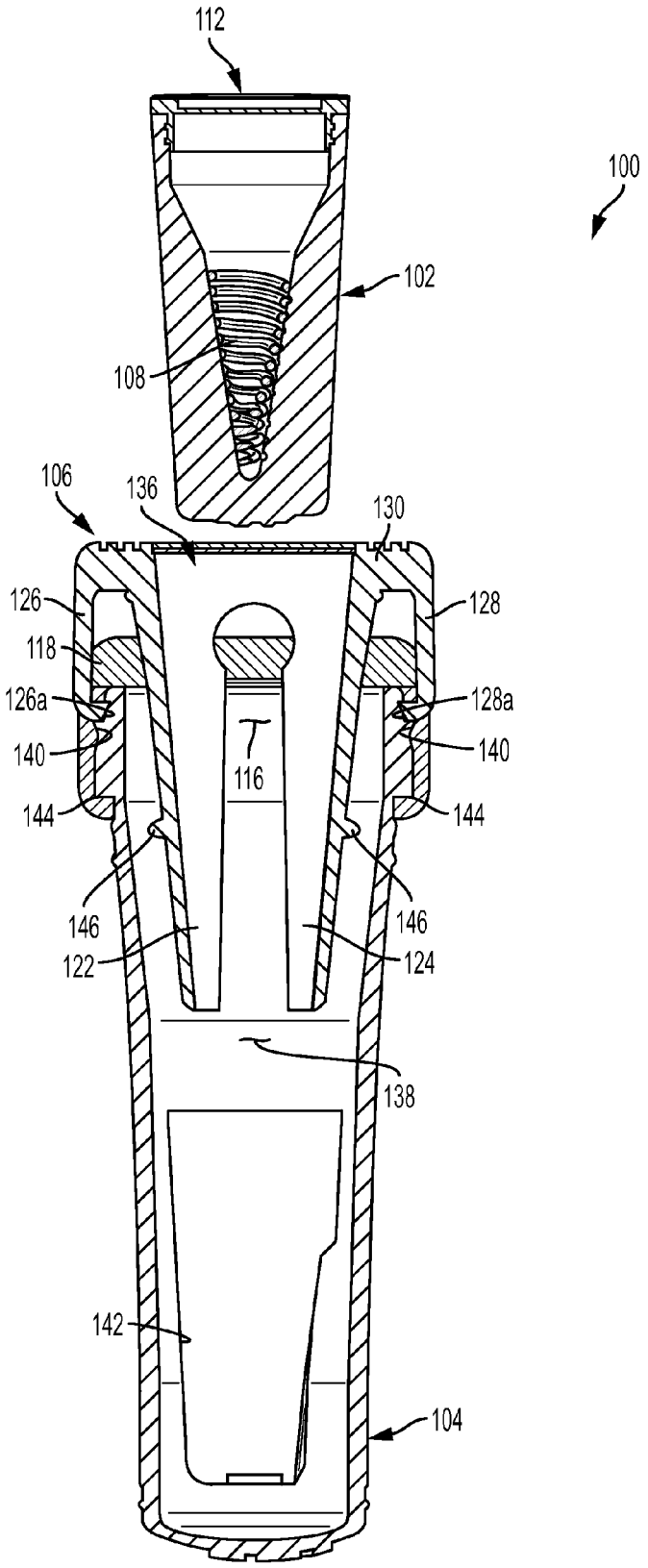
FIG. 6 is a sectional view of the assembly of FIG. 1, with the connector above the retainer and the body and with the retainer shown in the first position partially inserted into the body of the assembly.

As shown in FIG. 6, in the illustrated embodiment, the retainer 106 is initially positioned in the body 104 in a first position (e.g., a staging position, etc.), with the arms 122, 124 of the retainer 106 initially located (or positioned) within a channel 138 of the body 104, through the body's upper opening 116, and the clasps 126, 128 of the retainer 106 engaging the body 104 at the guides 120. End portions **126*a*, 128*a* of each of the clasps 126, 128 are located in corresponding detents 140 in upper portions of the guides 120 of the body 104 to help hold the retainer 106 in the first position. The upper opening 136 of the retainer 106 generally aligns with the upper opening 116 of the body 104**.

Figure 7:
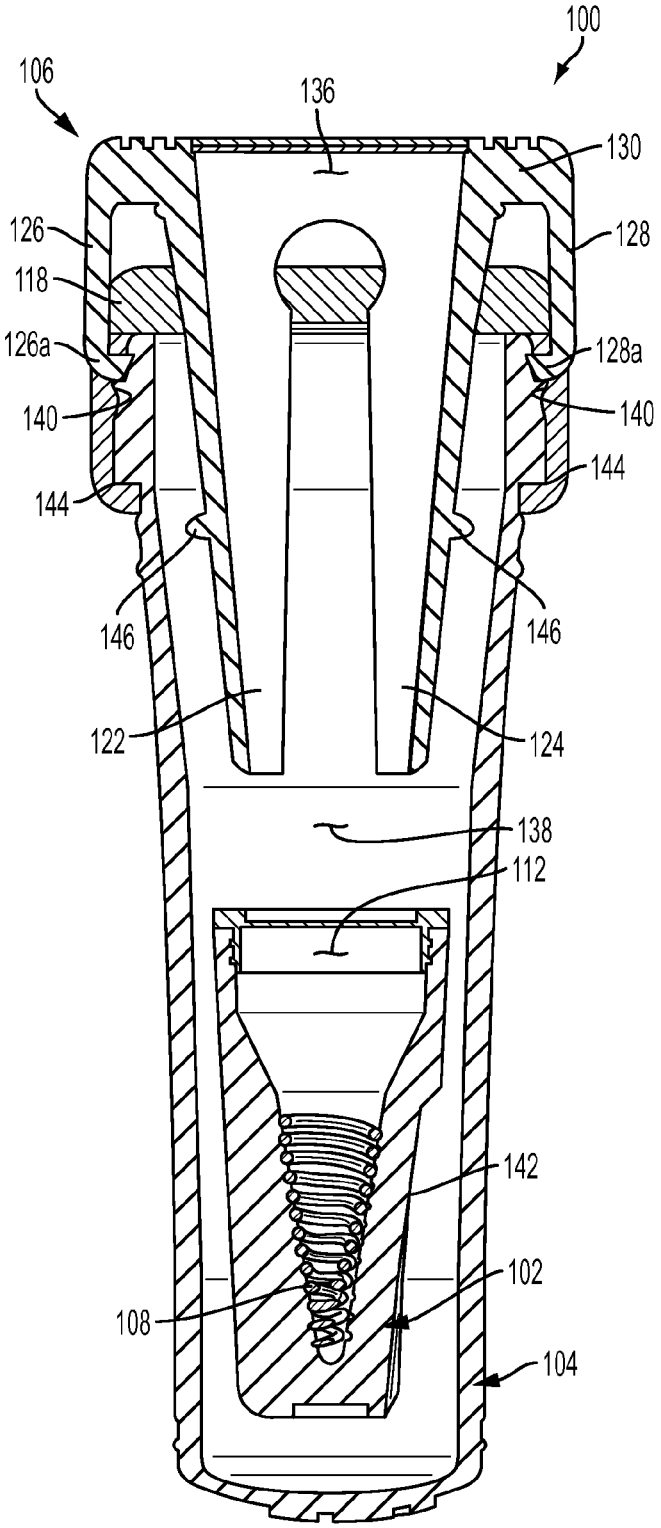
FIG. 7 is the sectional view of FIG. 6, with the connector inserted into the body of the assembly.

With additional reference to FIG. 7, the connector 102 (and the wires electrically connected therein) is then inserted into the body 104 through the aligned openings 136, 116 of the retainer 106 and the body 104 (with the retainer 106 still in the first position). Here, the arms 122, 124 of the retainer 106 are spaced apart by a first distance (in a normal, un-flexed, position as shown in FIG. 6). When receiving the connector 102 into the body 104, and through the retainer 106, the arms 122, 124 are pushed apart by the connector 102 (e.g., the arms 122, 124 resiliently flex away from each other, etc.) to provide room for the connector 102 to move between the arms 122, 124, through the retainer 106, and into a lower receptacle 142 of the body's channel 138. Once the connector 102 moves past the arms 122, 124 and through the retainer 106, the arms 122, 124 move back to the normal position (e.g., the arms 122, 124 move back toward each other, etc.), into a location generally over the connector 102.

Figure 8:
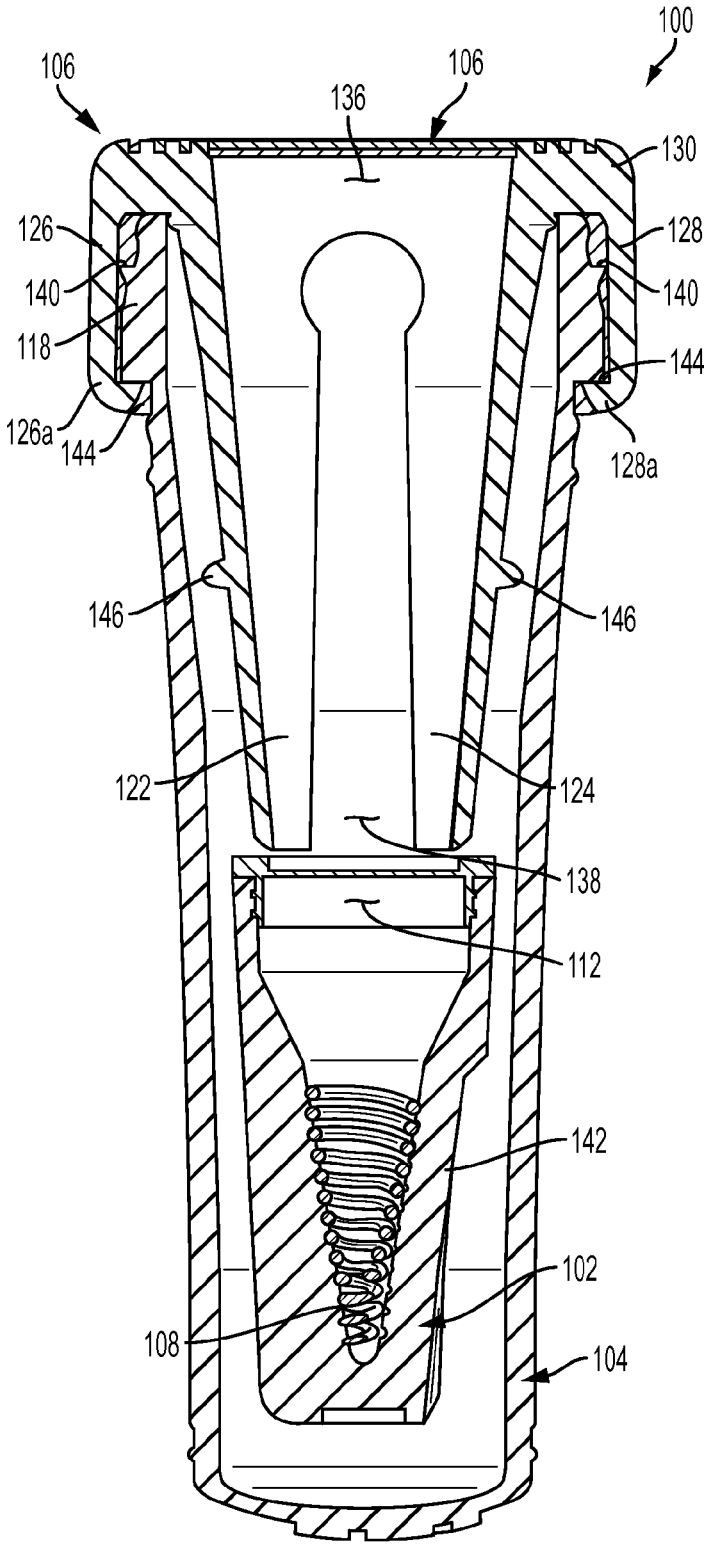
FIG. 8 is the sectional view of FIG. 7, with the retainer moved from the first position to a second position fully inserted into the body.

With further reference to FIG. 8, after the connector 102 is received in the body 104, the retainer 106 is moved (e.g., pressed, etc.) toward (or generally into, etc.) the body 104 (e.g., by a user, etc.), to a second position (i.e., the retainer 106 is moved from the first position in FIG. 7 to the second position in FIG. 8). In so doing, the end portions **126*a*, 128*a* of the clasps 126, 128 are pushed (e.g., cammed, etc.) out of the detents 140, and the clasps 126, 128 resiliently move, flex, etc. generally outward (e.g., away from each other, etc.). The clasps 126, 128 then slide along the guides 120 (in a direction toward the closed end of the body 104) until the end portions 126*a*, 128*a* of the clasps 126, 128 reach lips 144 of the guides 120, at which time the end portions 126*a***,

128*a* are pushed under the lips 144 by the resilient nature of the clasps 126, 128. In this position, the neck 130 of the retainer 106 generally engages (and seals against, etc.) the rim 118 of the body 104. At the same time, the arms 122, 124 of the retainer 106 move within the body's channel 138 toward the connector 102 (and, in some embodiments, into engagement with an upper portion of the connector 102) for inhibiting movement of the connector 102 out of the lower receptacle 142 (e.g., back through the body 104 and the retainer 106 of the assembly 100, etc.). In this manner, the retainer 106 is snap-fit, releasably coupled, etc. to the body 104 of the assembly 100 (e.g., via the clasps 126, 128, etc.). The retainer 106 can be released from the body 104, if desired (e.g., to remove the connector 102 from the body 104, etc.), by moving the end portions 126*a*, 128*a* of the clasps 126, 128 out of the lips 144 and sliding the retainer 106 off the body 104. I In some embodiments, the retainer 106 may include additional seals (e.g., on the arms 122, 124, on the neck 130, etc.) that contact, for example, the body 104, etc. when in the second position to further help inhibit water, debris, other substances etc. from entering the assembly 100, after the retainer 106 is coupled to the body 104.

In the illustrated embodiment, the body 104 includes an insulating material (or sealant) therein (e.g., in the channel 138, etc.) to help coat, surround, etc. the connector 102 when received in the body 104 (and the bare end portions of the wires therein, etc.). As previously stated, any suitable insulating material may be used including, for example, a moisture resistant encapsulant or gel that is viscous or non-viscous, a hardening or non-hardening epoxy or potting compound, etc. In some implementations, the insulating material may have a sufficient viscosity so that it will not flow out of the body 104 of the assembly 100, but at the same time will move with the connector 102 and flow around it as it moves into the body 104 (e.g., to provide a seal around the connected wires to inhibit water and/or other substances from interfering with the electrical connection of the wires, etc.).

With that said, and as can be appreciated, when the connector 102 is received in the body 104 of the assembly 100 (and moves though the body's channel 138), it displaces the insulating material therein and may leave a void generally above the connector 102 (e.g., along the path of the connector's movement through the body's channel 138, etc.). Uniquely in the illustrated assembly 100, the arms 122, 124 of the retainer 106 operate to move, direct, etc. insulating material back into this void, over the connector 102, once the connector 102 is positioned in the lower receptacle 142 of the body's channel 138 (e.g., the insulating material from the lower receptacle 142 that is displaced by the connector 102 is directed by the arms 122, 124 back over the connector 102, etc.), to help surround the connector 102 with insulating material and seal the connector 102 in the lower receptacle 142. For example, as described above, when receiving the connector 102 into the body 104 (through the retainer 106), the arms 122, 124 of the retainer 106 are initially pushed apart by the connector 102. Once the connector 102 moves past the arms 122, 124, the arms 122, 124 move back to the normal position (generally over the connector 102). During this movement, the arms 122, 124 also operate to pull displaced insulating material back and over the connector 102. Then, when the retainer 106 is moved from the first position to the second position, the arms 122, 124 push this insulating material down and onto the connector 102, generally toward, over, etc. the opening 112 of the connector 102, etc. to help implement the seal. Further, rings 146 on the arms of the retainer 106 may further help move the insulating material toward the opening 112 of the connector 102. These features may reduce the need to agitate the insulating material in the body 104, for example, by moving the connector 102 up and down in the insulating material (as done in previous assemblies), which may lead to formation of smaller air bubbles, other voids, or disconnection of the wires in the connector 102.

In the illustrated embodiment, the connector 102 may only be capable of being inserted through aligned upper openings 136, 116 of the retainer 106 and the body 104 when the retainer 106 is in the first position (FIG. 6), and not when the retainer 106 is in the second position (FIG. 8). For example, when the retainer 106 is in the first position, the arms 122, 124 of the retainer 106 are permitted to expand, separate, flex, etc. enough to allow the connector 102 to pass by the arms 122, 124 and through the retainer 106 (and into the lower receptacle 142 of the body's channel 138). When the retainer 106 is in the second position, the arms 122, 124 are prevented from expanding, separating, flexing, etc. and allowing the connector 102 to pass through them (e.g., because the arms 122, 124 contact a narrower width of the body 104 when the retainer 106 is in the second position, etc.). In other embodiments, however, the connector 102 may be capable of being inserted through aligned upper openings 136, 116 of the retainer 106 and the body 104 when the retainer 106 is in the first position (FIG. 6) and when the retainer 106 is in the second position (FIG. 8). In these embodiments, after the connector 102 is located in the lower receptacle 142 of the body's channel 138, the resilient nature of the arms 122, 124 of the retainer 106 (generally biasing, and holding, the arms 122, 124 in the normal, un-flexed, position) then operates to locate the arms 122, 124 generally over the retainer 106 and inhibit movement of the retainer 106 out of the lower receptacle 142. Also in these embodiments, the first positon of the retainer 106 may be removed or eliminated.

Although, in the illustrated embodiment, the retainer 106 is partially coupled to the body 104 (in the first position) before the connector 102 (with wires pre-inserted) is received into the body 104 (through the aligned openings 136, 116 of the retainer 106 and the body 104), it should again be appreciated that in some implementations the connector 102 may be inserted into the body 104 prior to positioning the retainer 106 in the body 104. Further, in some implementations, the wires may be inserted into the connector 102 after the connector 102 is received in the body 104. Further yet, in some implementations, the wires may be inserted into the connector 102 and the connector 102 then inserted through the retainer 106 (before the retainer 106 is positioned in the body 104). And, the connector 102 and retainer 106 may then be inserted into the body 104 (this may require keeping the retainer 106 and body 104 separate).

It should be appreciated that the assembly 100 of the present disclosure may allow for more efficient and reliable electrical connection and ease of use by a user. In one example, the user can simply insert the wires into the connector 102, then insert the connector 102 (with the wires connected therein) through a pre-assembled arrangement of the retainer 106 and the body 104 (e.g., with the retainer 106 already positioned, out of the packaging, in the body 104 in the first position, etc.). In another example, the assembly 100 may be received by a user in two parts. The first part may include the body 104, filled with a sealant (e.g., grease, etc.), and the retainer 106 coupled to the body 104 as a complete unit. The second part may then include the connector 102

(e.g., a twist-on wire connector, etc.), which may or may not be filled with sealant. Here, a splice (e.g., a connection, coupling, etc.) of at least two wires may be made by aligning a conductor of each wire, placing the connector 102 onto the conductors of the wires, and twisting the connector 102. The connector 102 is then plunged into the sealant in the body 104. The retainer 106 is then pressed into the second, locking position, which (as previously described) directs the sealant (e.g., folds the sealant, displaces the sealant, directs the sealant, etc.) over the top of the wire connector 102 to close any channel that may have formed when plunging the connector 102 into the sealant in the body 104, thereby inhibiting entry of water or other debris. This also helps secure the connector 102 in the body 104 adjacent the bottom of the body 104 and generally creates a wire restraint.

Exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that exemplary embodiments may be embodied in many different forms, and that neither should be construed to limit the scope of the disclosure. In some exemplary embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values is not exclusive of other values that may be useful in one or more of the examples disclosed herein.

The terminology used herein is for the purpose of describing particular exemplary embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments.

Spatially relative terms, such as "inner," "outer," "beneath," "below," "lower," "above," "upper," "left,", "right" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With that said, the foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly for electrically connecting at least two wires, the assembly comprising:

a body configured to receive a connector therein for electrically connecting at least two wires, the body including at least one lip defined on an external portion of the body; and a retainer configured to releasably couple to the body, the retainer having at least one arm configured to extend into the body, when the retainer is coupled to the body, and inhibit movement of the connector out of the body after the connector is received in the body, the retainer including at least one clasp configured to engage the at least one lip for releasably coupling the retainer to the body.

2. The assembly of claim 1, further comprising the connector.

3. The assembly of claim 2, wherein the connector defines an opening for receiving the at least two wires into the connector for electrically connecting the at least two wires; and wherein the connector includes a plurality of fingers adjacent the opening for flexibly engaging the at least two wires when received through the opening of the connector.

4. The assembly of claim 3, wherein the connector includes a metallic coil for electrically connecting the at least two wires when the at least two wires are received in the connector.

5. The assembly of claim 2, further comprising a sealant disposed within the body and/or the connector.

6. The assembly of claim 5, wherein the sealant is disposed within the body; and wherein the connector defines an opening for receiving the at least two wires into the connector, the at least one arm of the retainer further configured to direct the sealant toward the opening of the connector, after the connector is received in the body and when the retainer is coupled to the body.

7. The assembly of claim 1, wherein the body defines an opening configured to permit the connector to be inserted through the opening and into the body, the retainer configured to releasably couple to the body adjacent the opening of the body.

8. The assembly of claim 7, wherein the retainer defines an opening configured to generally align with the opening of the body when the retainer is coupled to the body, the aligned openings of the body and the retainer configured to receive the connector therethrough for receiving the connector into the body.

9. The assembly of claim 1, wherein the retainer defines an opening configured to receive the connector therethrough when receiving the connector in the body.

10. The assembly of claim 9, wherein the at least one arm of the retainer includes two arms; and wherein the two arms are configured to resiliently move generally away from each other to permit the connector to pass between the two arms when receiving the connector in the body, and then to move generally toward each other after the connector is received in the body.

11. The assembly of claim 9, wherein the retainer includes a plurality of fingers adjacent the opening of the retainer for flexibly engaging the at least two wires electrically connected by the connector, when the connector is received in the body.

12. The assembly of claim 1, wherein the at least one clasp includes a first clasp and a second clasp spaced apart from the first clasp, and wherein the at least one lip includes a first lip and a second lip spaced apart and separate from the first lip.

13. The assembly of claim 1, wherein the body further includes at least one detent defined on an external portion of the body; and wherein the retainer is moveable relative to the body between a first position and a second position, the at least one clasp configured to engage the at least one detent for releasably coupling the retainer to the body in the first position, and the at least one clasp configured to engage the at least one lip for releasably coupling the retainer to the body in the second position.

14. An assembly for electrically connecting wires, the assembly comprising:

a connector configured to electrically connect the wires;

a body defining an opening for receiving the connector into the body when the connector is electrically connecting the wires;

a sealant disposed within the body; and a retainer configured to couple to the body adjacent the opening of the body, the retainer having at least one arm configured to extend through the opening of the body, when the retainer is coupled to the body, to inhibit movement of the connector out of the body after the connector is received in the body, the at least one arm defining at least one ring disposed on a surface of the at least one arm to direct the sealant toward the connector.

15. The assembly of claim 14, further comprising a sealant disposed within the connector.

16. The assembly of claim 15, wherein the at least one arm of the retainer is further configured to direct the sealant toward the connector, after the connector is received in the body and when the retainer is coupled to the body.

17. The assembly of claim 14, wherein the retainer defines an opening configured to generally align with the opening of the body when the retainer is coupled to the body, the aligned openings of the body and the retainer configured to receive the connector therethrough for receiving the connector in the body.

18. The assembly of claim 14, wherein the at least one arm of the retainer includes two arms; and wherein the two arms are configured to resiliently move generally away from each other to permit the connector to pass between the two arms when receiving the connector in the body, and then to move generally toward each other after the connector is received in the body.

19. A method of making an electrical connection using an electrical connecting assembly, the method comprising:

inserting at least two electrical wires into an opening of a connector of the assembly;

releasably coupling a retainer of the assembly to a body of the assembly in a first position;

moving the connector through an opening of the retainer of the assembly and into the body of the assembly; and uncoupling the retainer of the assembly from the body of the assembly and recoupling the retainer to the body in a second position, different from the first position, by pushing the retainer further into the body, such that an arm of the retainer is positioned within the body for inhibiting movement of the connector out of the body;

wherein the retainer is configured to permit the connector to be inserted through the retainer and into the body when the retainer is coupled to the body in the first position, and wherein the retainer is configured to inhibit the connector from being inserted into the body when the retainer is coupled to the body in the second position.

20. The method of claim 19, wherein the arm of the retainer of the assembly is a first arm, the retainer further including a second arm; and wherein moving the connector through the opening of the retainer of the assembly includes moving the first and second arms of the retainer generally away from each other to permit the connector to pass through the opening and between the arms so that the connector can be received in the body of the assembly, and then moving the first and second arms generally toward each other after the connector is received in the body of the assembly.

21. The method of claim 19, wherein coupling the retainer of the assembly to the body of the assembly includes directing sealant in the body, using the arm of the retainer, toward the connector.

* * * * *